US007721494B2

(12) United States Patent
Lee

(10) Patent No.: US 7,721,494 B2
(45) Date of Patent: May 25, 2010

(54) STRENGTHENING DEVICE TO INCREASE STRENGTH OF GROUT LAYER

(75) Inventor: Dae Yong Lee, Seoul (KR)

(73) Assignee: Research Institute of Industrial Science & Technology (KR)

( * ) Notice: Subject to any disclaimer, the term of this patent is extended or adjusted under 35 U.S.C. 154(b) by 1168 days.

(21) Appl. No.: 11/179,718

(22) Filed: Jul. 12, 2005

(65) Prior Publication Data

US 2006/0048471 A1 Mar. 9, 2006

(30) Foreign Application Priority Data

Sep. 6, 2004 (KR) ..... 10-2004-0070810
Jun. 10, 2005 (KR) ..... 10-2005-0049904

(51) Int. Cl.
*E02D 27/00* (2006.01)
*E02D 27/32* (2006.01)

(52) U.S. Cl. ..... 52/297; 52/82; 52/742.14; 52/742.16; 52/219; 24/21; 24/248; 249/48

(58) Field of Classification Search ..... 52/745.07, 52/82, 407.4, 732.1, 742.14, 742.16, 219, 52/294, 295, 296, 297, 74.15, 741.14, 745.17, 52/745.18, 838; 405/230; 24/21, 248; 403/286, 403/292, 296, 294; 256/65.14; 249/48, 51; 264/32

See application file for complete search history.

(56) References Cited

U.S. PATENT DOCUMENTS 998,575 A * 7/1911 Hanson ..... 52/82
1,646,639 A * 10/1927 Crowell ..... 285/123.4
1,710,060 A * 4/1929 Metcalf, Jr. ..... 285/149.1
3,355,852 A * 12/1967 Lally ..... 52/834
3,468,084 A * 9/1969 Vaessen ..... 52/125.1
3,798,867 A * 3/1974 Starling ..... 52/834
3,939,665 A * 2/1976 Gosse et al. ..... 405/216
4,507,069 A * 3/1985 Murray et al. ..... 405/230
5,946,881 A * 9/1999 Chatelain ..... 52/741.14
6,148,585 A * 11/2000 Baker ..... 52/834
6,513,291 B2 * 2/2003 Gilsdorf ..... 52/297
7,010,889 B1 * 3/2006 Renfro ..... 52/219

FOREIGN PATENT DOCUMENTS

JP 62-143758 U 9/1987
JP 10-331170 A 12/1998
JP 2001-311219 A 11/2001

* cited by examiner

*Primary Examiner*—Richard E Chilcot, Jr.
*Assistant Examiner*—Chi Q Nguyen
(74) *Attorney, Agent, or Firm*—The Webb Law Firm

(57) ABSTRACT

Provided is a strengthening device to increase the strength of a grout layer. In the strengthening device, clamp members are interconnected and clamped to surround a grout layer on a concrete base, on which an upper structure is installed, so as to increase the strength of the grout layer. Connection members are provided to edges of the clamp members to connect the clamp members. Fastening means is fastened between the connection members in order to enable the clamp members to clamp the grout layer. This strengthening device acts as a mold to facilitate easy construction when grout is placed, and surrounds the grout layer to increase the strength of the grout layer after grout is cured, thereby effectively preventing and minimizing failure of the grout layer caused by loads transferred from an upper structure such as a column member or a bridge bearing.

13 Claims, 14 Drawing Sheets

STRENGTHENING DEVICE TO INCREASE STRENGTH OF GROUT LAYER

CROSS REFERENCE TO RELATED APPLICATION

The present application is based on, and claims priority from, Korean Application Number 2004-70810 filed Sep. 6, 2004, and Korean Application Number 2005-49904 filed Jun. 10, 2005, the disclosure of which is hereby incorporated by reference herein in its entirety.

BACKGROUND OF THE INVENTION

1. Field of the Invention

The present invention relates to a strengthening device to increase the strength of a grout layer, placed on a concrete base for keeping a structural safety of an upper structure, and more particularly to a strengthening device to increase the strength of a grout layer, which improves a structural safety of an upper structure by fastening the grout layer placed on a concrete base to give a restraining force thereto so that a failure of the grout layer due to loads transferred from the upper structure such as a column member or a bridge bearing installed on the grout layer may be prevented or minimized.

2. Description of the Related Art

As is well known in the art, a grout layer is placed on a concrete base to act for adjusting a vertical position and a horizontal state of an upper structure so that the upper structure such a column member or a bridge bearing may be installed on the concrete base.

In addition, in the case that the upper structure is a column member, the grout layer plays another role of distributing vertical load F (see FIG. 1) and moment load M1 and M2 (see FIG. 1) transferred through a column of the column member.

Thus, such a grout layer should have sufficient strength to resist bearing failure or edge failure.

In the case where the upper structure is a column member for example, the grout layer formed on a concrete base by placing non-shrinkage mortar at a position right below the column of the column member provides a bearing strength sufficiently resisting against a vertical load F (see FIG. 1) and a moment load M1 and M2 (see FIG. 1) transferred down through the column.

However, since an edge of the grout layer has no restraining force applied inward from the outline, the strength of the edge against the moment load is relatively weaker than that against the vertical load.

For example, if a large moment load M1 or M2 (see FIG. 1) is applied to a column member, or an upper structure installed on the grout layer, due to wind or earthquake, a great bearing stress is generated at the edge and corner of a base plate of the column member installed on the grout layer due to rotation of the base plate.

The excessive bearing stress generated along the edge or the corner of the grout layer becomes a fatal factor of crack or failure on the grout layer unless a restraining force is applied inward (or, toward a center) from an outline of the grout layer.

As a result, moment loads repeatedly applied to the upper structure such as a column member may break down the grout layer easily.

In addition, this phenomenon makes it difficult that loads transferred from the upper structure are distributed to the concrete base, resulting in deteriorated structural safety of the grout layer as well as the upper structure such as a column member or a bridge bearing installed thereon.

Accordingly, there has been needed a technique for a strengthening device (or, a reinforcing device) to increase the strength of a grout layer, which may surround and clamp an outline of a grout layer on a concrete base on which an upper structure such as a column member or a bridge bearing is installed so as to improve the safety of the grout layer as well as an upper structure installed thereon, so that the strength of the grout layer, particularly bearing strength at its edge or corner may be enhanced.

SUMMARY OF THE INVENTION

Accordingly, the present invention is directed to a strengthening device to increase the strength of a grout layer that substantially obviates one or more problems due to limitations and disadvantages of the related art.

An object of the present invention is to provide a strengthening device to increase the strength of a grout layer, which improves a structural safety of an upper structure by effectively preventing or minimizing a failure of the grout layer due to vertical load and moment load transferred from the upper structure, such as a column member or a bridge bearing.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a strengthening device to increase the strength of a grout layer, which includes: clamp members interconnected and clamped to surround a grout layer on a concrete base on which an upper structure is installed, so as to increase the strength of the grout layer; connection members provided to edges of the clamp members to connect the clamp members; and fastening means fastened between the connection members in order to enable the clamp members to clamp the grout layer.

The clamp members may respectively have a curved shape so as to clamp the grout layer with forming a circular looped section.

As an alternative, the clamp members may respectively have a linear shape bent at a right angle or at an obtuse angle so as to clamp the grout layer with forming a polygonal looped section.

In addition, the clamp members may be made of steel material or fiber reinforced plastic (FRP).

Further, the connection members may be formed to be integrally bent from edges of the clamp members respectively, and each of the connection members has a fastening hole into which each of the fastening means is fastened.

Furthermore, the fastening means may be composed of a bolt and a nut, which are fastened through a fastening hole of each connection member so as to allow the grout layer to be clamped by the clamp members.

Meanwhile, the strengthening device may further include grout blocking members provided between the connection members and the grout layer so as to prevent grout from leaking out through a gap between the connection members.

At this time, the grout blocking members are preferably used when grout is placed and have a plate shape made of steel material or FRP in correspondence with a shape of the clamp members, and the grout blocking members are preferably provided separately from the clamp members.

In addition, the grout blocking member may additionally have a hook hanging on the clamp member.

In particular, the strengthening device may further include a grout layer leveling means provided to the clamp member.

At this time, the grout layer leveling means may have a leveling scale integrally formed on at least one point of an inner wall of the clamp member.

In addition, the strengthening device may further include a clamp member leveling means for adjusting a level state of the clamp members themselves placed on the concrete base.

At this time, the clamp member leveling means may have a leveling bolt fastened into a plurality of screw grooves formed in bottoms of the clamp members or with screw holes formed in a plurality of brackets installed to outer walls of the clamp members.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
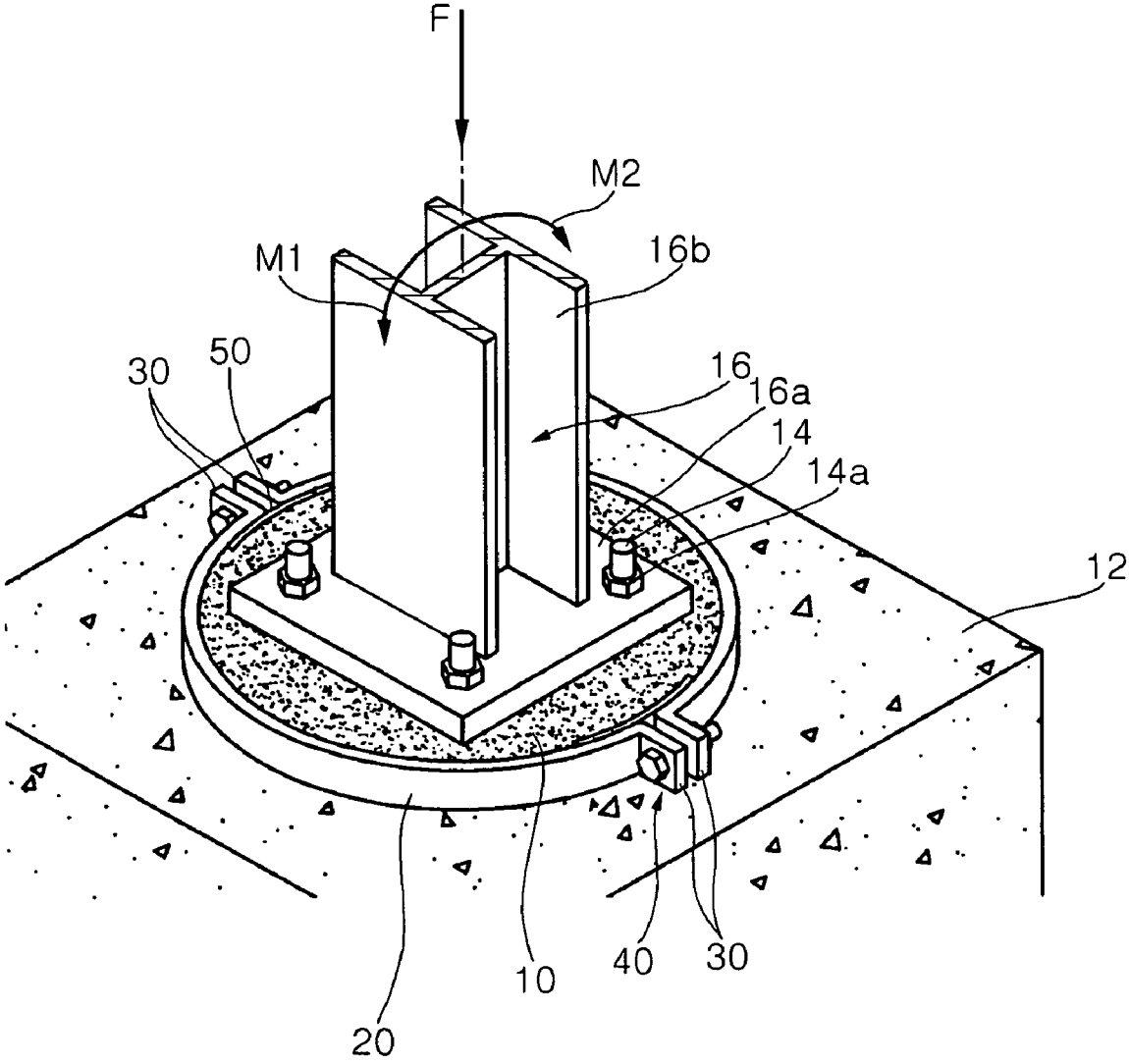
FIG. 1 is a perspective view of a strengthening device to increase the strength of a grout layer according to a first embodiment of the present invention.
Figure 2A:
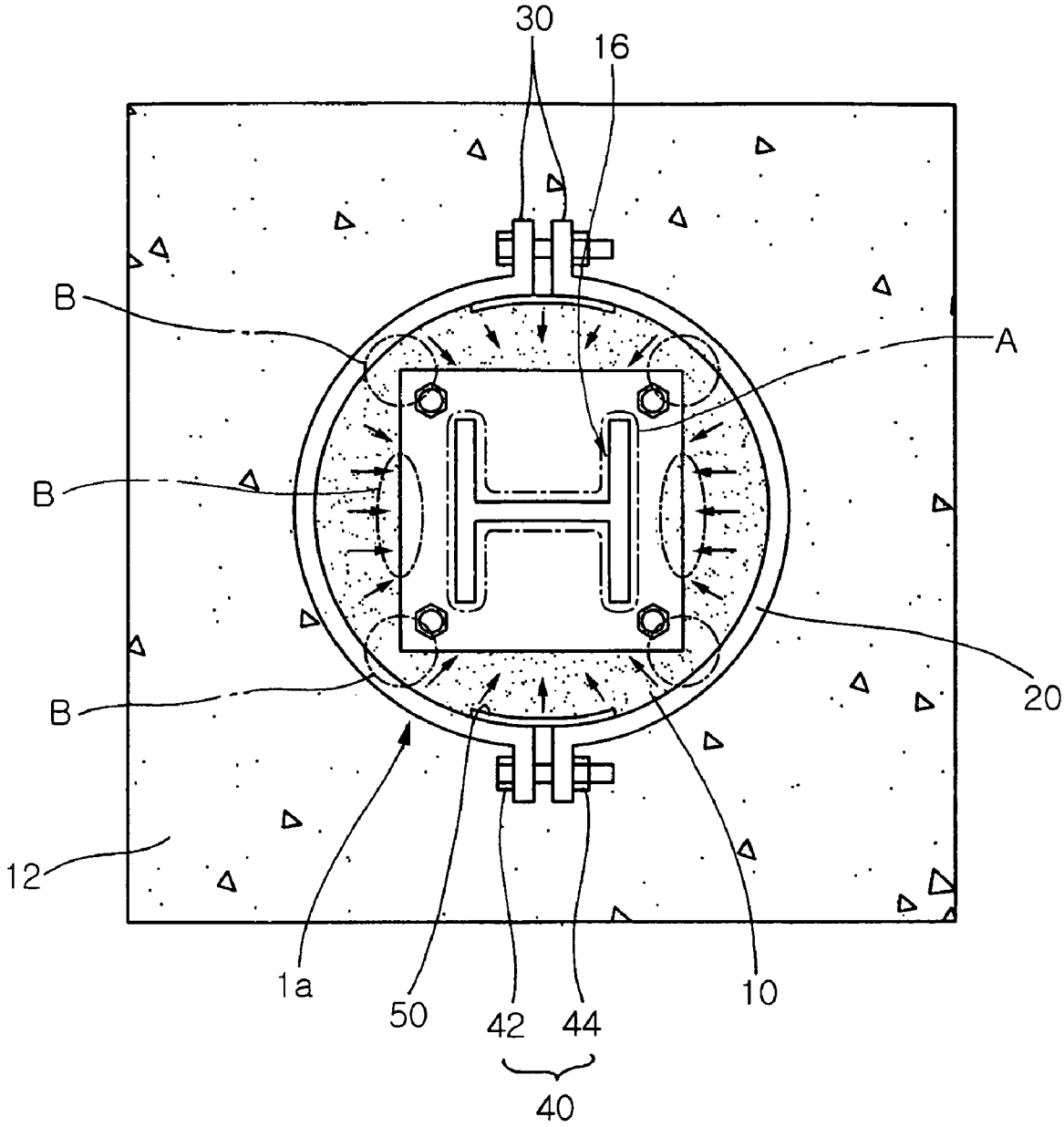
FIG. 2*a* is a plan view illustrating an operation state of a strengthening device according to a first embodiment of the present invention, in which a looped section of the strengthening device is formed in a circular shape.
Figure 2B:
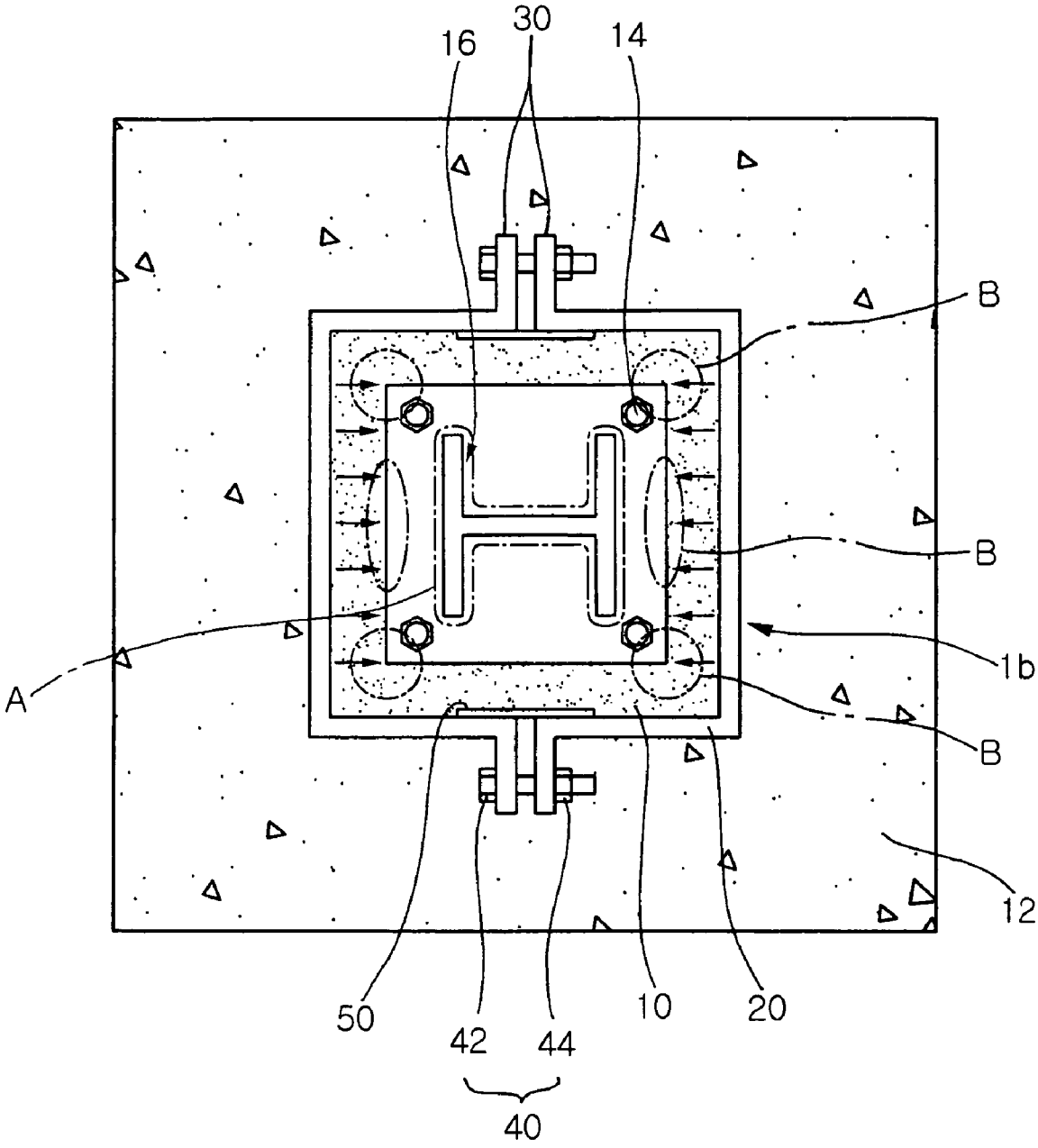
FIG. 2*b* is a plan view illustrating an operation state of a strengthening device according to a second embodiment of the present invention, in which a looped section of the strengthening device is formed in a quadrangular shape.

FIG. 1 shows a strengthening device to increase the strength of a grout layer in a used state according to a first embodiment of the present invention, FIG. 2*a* shows operation of the strengthening device to increase the strength of a grout layer according to the present invention, and FIG. 2*b* shows operation of the strengthening device to increase the strength of a grout layer according to a second embodiment.

First, the operation principle of the strengthening device to increase the strength of a grout layer according to the present invention is described with reference to FIGS. 1, 2*a* and 2*b*.

As shown in FIG. 1, non-shrinkage mortar is placed on a concrete base 12 to form a grout layer 10, and an anchor bolt 14 installed in construction of the concrete base 12 is protruded through the grout layer 10.

Accordingly, in case that an upper structure is a column member 16 as shown in FIG. 1, a base plate 16*a* adhered to the lower end of a column 16*b* is combined to the anchor bolt 14 by means of a nut 14*a*, so that the column member 16 of the upper structure mentioned above is installed on the grout layer 10.

At this time, a vertical load 'F' transferred down from an upper structure such as a bridge bearing (not shown) or the column member 16 shown in FIG. 1 is focused on a portion 'A' (see FIGS. 2*a* and 2*b*) of the grout layer just below the upper structure. In this case, the grout layer 10 keeps good strength against the vertical load, thereby preventing cracks from being generated in the grout layer 10.

However, if wind or earthquake gives an influence on the column member 16 that is an upper structure installed on the grout layer 10 in FIG. 1 so that a large moment load 'M1' or 'M2' is applied to the column 16*b*, a large bearing stress is generated at edges and corners 'B' (see FIGS. 2*a* and 2*b*) of the grout layer 10 under the base plate 16*a*.

Thus, without the strengthening device of the present invention, a restraining force is not applied inward from an outline of the grout layer, so the grout layer is apt to be easily cracked or failed above the 'B' portions.

However, as shown in FIGS. 1, 2*a*, and 2*b*, the strengthening device 1*a* or 1*b* to increase the strength of a grout layer surrounds and clamps (or, compresses) the grout layer 10 to give a restricting force inward (toward a center) from the outline of the grout layer, thereby increasing a bearing strength. Thus, it is possible to effectively prevent or at least minimize failures of the grout layer, particularly at outline, edges or corners of the grout layer caused by the vertical load F and moment load M1 or M2 transferred through the upper structure.

Accordingly, the strengthening device of the present invention may ensure structural safety of the grout layer 10 as well as the upper structure such as a column member or a bridge bearing installed thereon.

That is to say, the strengthening devices 1*a* and 1*b* to increase the strength of a grout layer according to the first and second embodiments of the present invention surround and clamp the grout layer 10 in a closely contacted state as shown in FIGS. 1, 2*a*, and 2*b*, thereby capable of maximizing a bearing strength of the 'B' portion of the grout layer 10, which has weak strength.

Meanwhile, as shown in FIG. 2*a*, the strengthening device 1*a* to increase the strength of a grout layer according to the first embodiment configures a circular looped section by means of clamp members 20 assembled into a circular shape. Thus, hoop tension in the clamp members 20 applies regular clamping force (or, restraining force), expressed by arrows, to the grout layer. Thus, this strengthening device 1*a* is most preferable to increase a bearing strength.

In addition, the strengthening device 1*b* to increase the strength of a grout layer according to the second embodiment of the present invention configures a quadrangular looped section as shown in FIG. 2*b*. At this time, a restraining force (see arrows in FIG. 2*b*) applied to the grout layer by the strengthening device 1*b* is less regular as a whole than that by the strengthening device 1*a* of the first embodiment. Thus, the strengthening device 1*b* of the second embodiment is not so efficient to increase a bearing strength of the grout layer. However, considering that the upper structure is mostly a column member with an H-shaped section and a base plate at its lower end has a quadrangular shape, the strengthening device 1*b* is advantageous in aspect of space utilization.

Thus, the strengthening devices 1*a* and 1*b* of the first and second embodiments may be selectively used in consideration of the shape of the upper structure and the strength of the grout layer.

Meanwhile, reference numerals shown in FIGS. 1, 2*a*, and 2*b*, to denote various components will be fully described later in detail with reference to FIGS. 3*a* to 5*b*.

Now, the strengthening device to increase the strength of a grout layer according to the present invention may have following modifications. In the modifications, basic components are substantially identical to the first and second embodiments and denoted by the same reference numerals, except that the clamp member 20 has a circular or a quadrangular (or, polygonal) shape.

Figure 3A:
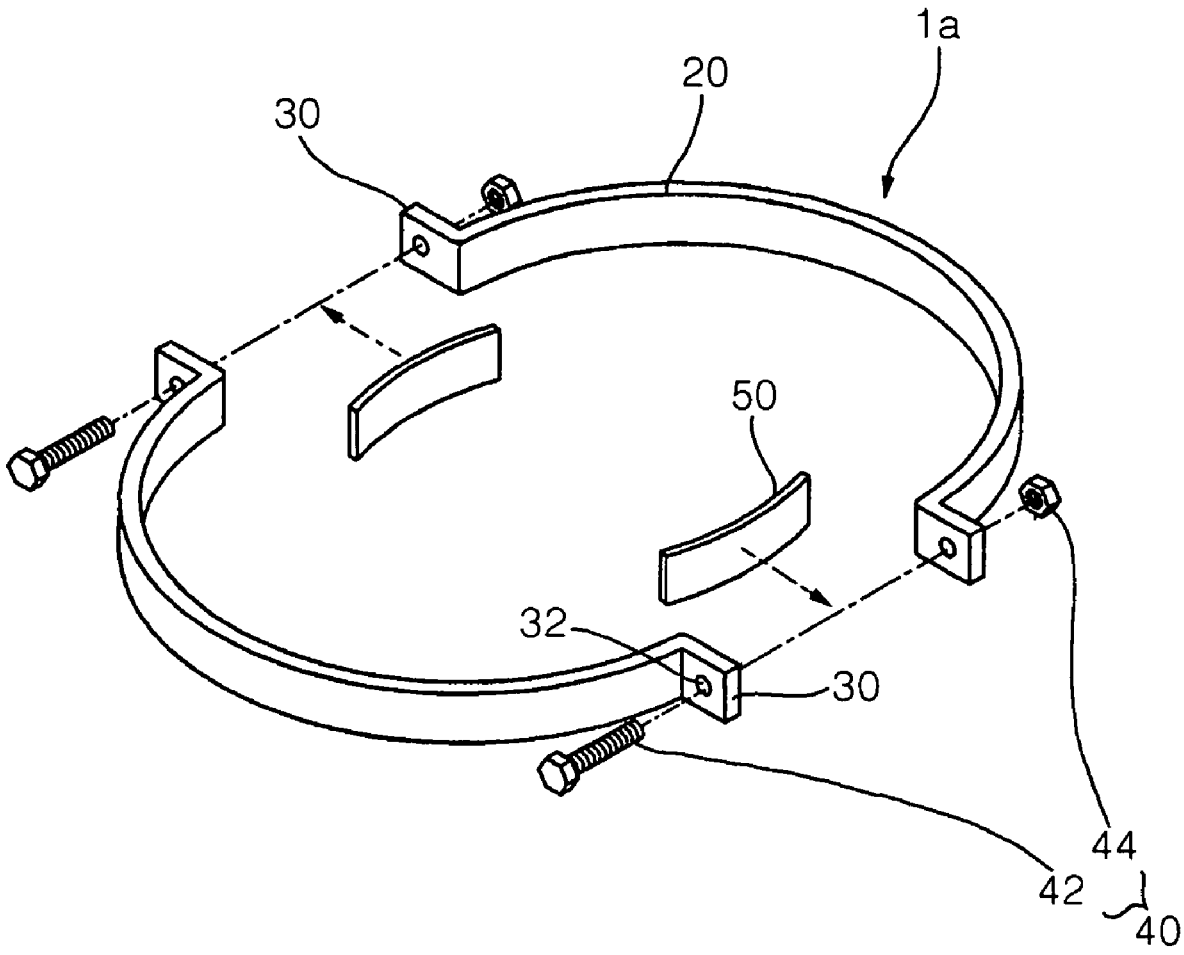
FIG. 3*a* is an exploded perspective view of the strengthening device according to the first embodiment of the present invention.
Figure 3B:
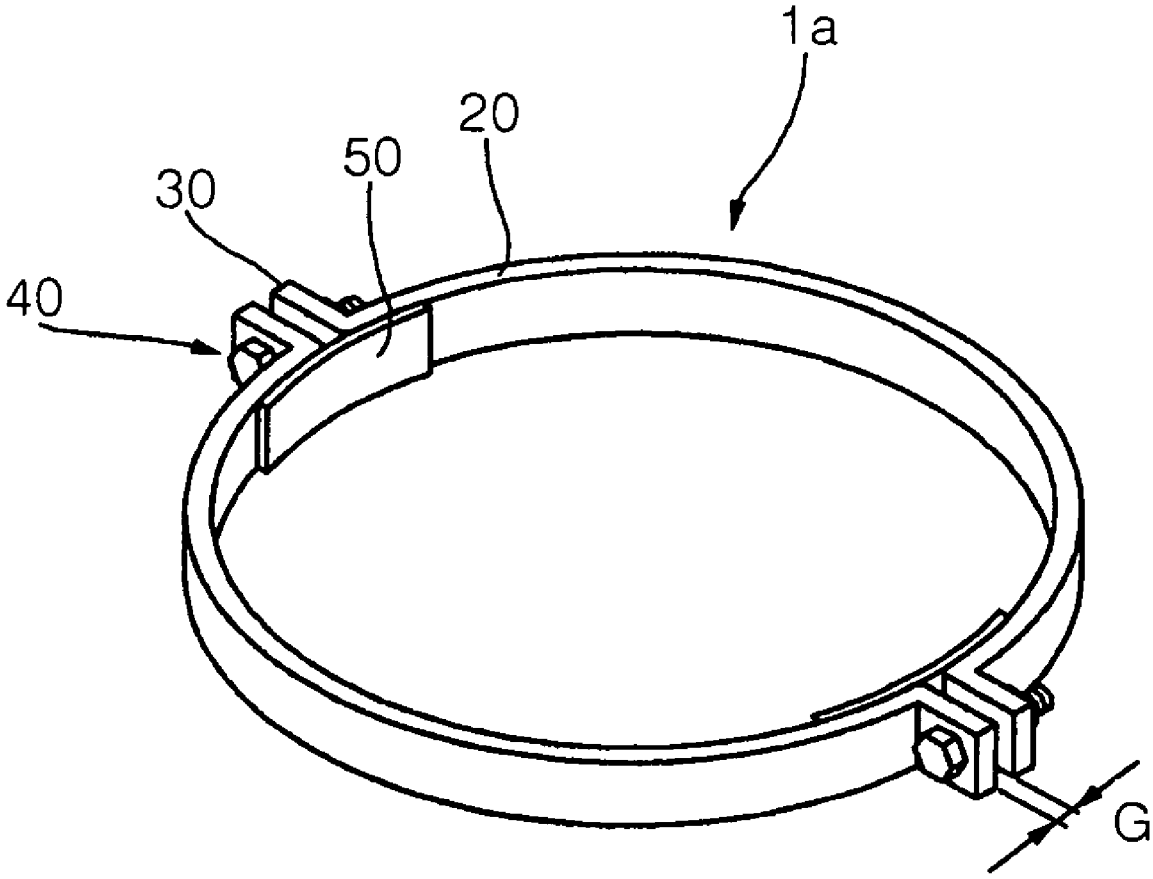
FIG. 3*b* is an assembled perspective view of the strengthening device according to the first embodiment of the present invention.
Figure 4:
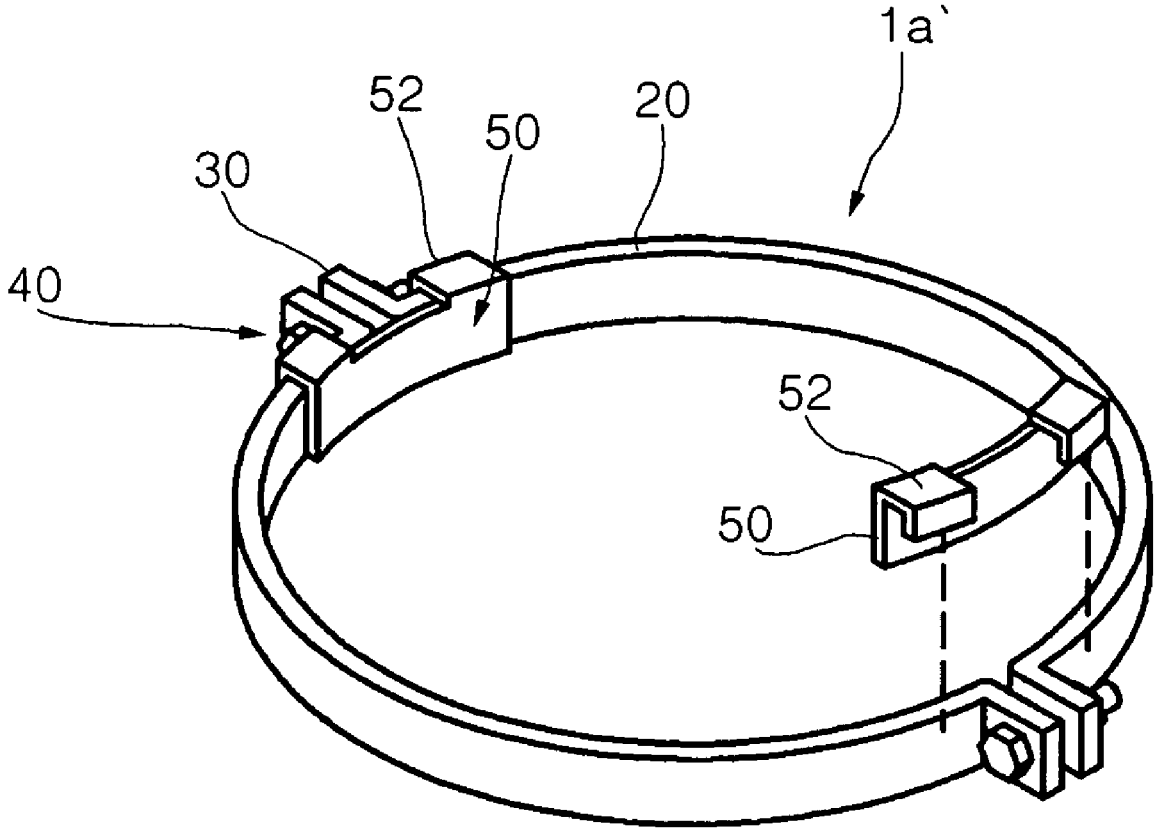
FIG. 4 is a perspective view illustrating a modification of the strengthening device according to the first embodiment of the present invention.

First, FIGS. 3*a*, 3*b*, and 4 show the strengthening device 1*a* of the first embodiment and its modification 1*a'*.

That is, as shown in FIGS. 3*a* and 3*b*, the strengthening device 1*a* of the first embodiment may include a plurality of clamp members 20, which are interconnected to form a circular looped section and provided to substantially surround and clamp the grout layer 10, clamp member connection members 30 each of which is provided to one end of the clamp member 20 integrally, and clamp member fastening means 40 combined to the connection members 30 to enable the clamp members to clamp the grout layer 10.

At this time, the clamp members 20 may have a semispherical or curved shape so as to form the circular looped section that clamps the grout layer 10.

In addition, the clamp member 20 may have a predetermined thickness of about 5 to 10 mm in order to keep its strength. This thickness range is selected in consideration of weight for carriage and handling, but not limitedly.

However, in case that the clamp members 20 forming a circular looped section as shown in FIG. 2*a* are used, the restraining force is uniformly applied to the grout layer 10. Thus, it is possible to increase a bearing strength of the grout layer 10 by using two semicircular clamp members 20 that form a circular looped section as a whole.

In addition, the clamp member 20 may be made of steel material or other synthetic resin with good strength such as FRP (Fiber Reinforced Plastic).

For example, the clamp member is preferably made of steel material in aspect of strength. However, synthetic resin allows reduced production costs and easy mass production by means of molding. Nowadays, synthetic resin may also have sufficient clamping strength along with technical development, so it is also possible to make the clamp member with FRP having strength beyond a certain level by means of injection molding.

At this time, since FRP does not cause corrosion, FRP can also advantageously prevent corrosion-induced strength deterioration in long time use. In addition, owing to small weight, FRP allows the clamp member to be handled more easily when carried or manipulated.

As shown in FIGS. 3*a* and 3*b*, the connection member 30 of the present invention is formed by being integrally bent from the edge of the clamp member 20. Such a connection member 30 has a fastening hole 32 into which each of the fastening means 40 are fastened.

At this time, the fastening hole 32 may be a screw hole into which a bolt 42 of the fastening means 40, described later, is screwed.

The fastening means 40 of the present invention includes a bolt 42 and a nut 44, which are fastened through the fastening hole 32 of the connection member 30 so as to increase clamping and bearing strength of the grout layer by the clamp member.

At this time, the nut 44 gives a function to substantially adjust a gap 'G' (see FIG. 3*b*) between the connection members 30.

Thus, as shown in FIG. 3*b*, the bolt and the nut acting as the fastening means 40 are fastened between the connection members 30 at edges of two clamp members 20 that have a circular looped section surrounding the grout layer 10. Then, if the nut 44 is turned, the gap 'G' between the connection members 30 is narrowed.

At this time, the grout layer 10 whose outline is clamped by the clamp members 20 is compressed so that its bearing strength is reinforced in a restraining direction shown by arrows in FIG. 2*a*.

As shown in FIGS. 3*a* and 3*b*, a grout blocking member 50 is preferably provided between the inside of the connection member 30 and the grout layer 10 in order to prevent grout from leaking out through the gap 'G' between the connection members 30.

At this time, in case that the strengthening device 1*a* of the present invention acts as a mold when grout is placed, the grout blocking member 50 prevents the grout from leaking out through the gap 'G' between the connection members 30.

For example, the grout blocking member 50 prevents grout from leaking out through the gap 'G' between the connection members 30 in case that the strengthening device 1*a* of the first embodiment is positioned on the concrete base 12, the fastening means are fastened, and the grout surrounded by the clamp members 20 is placed therein.

However, if grout is leaked out through the gap 'G' between the clamp member connection members 30, the leaked grout disturbs the fastening means 40 in fastening the clamp members 20, resultantly making it difficult to increase a bearing strength of the grout layer 10 by compression. Thus, the grout blocking member 50 is very useful to solve this problem.

Meanwhile, in case that the strengthening device of the present invention is used for a grout layer 10 that is completely cured, there is substantially no possibility that grout leaks out through the gap between the connection members 30. Thus, the grout blocking member 50 is more useful when the strengthening device of the present invention is used as a mold when grout is placed.

At this time, the grout blocking member 50 may be made of the same material as the clamp member 20, for example steel material or FRP. In this case, the grout blocking member 50 may not have the same thickness as the clamp member 20.

In addition, such a grout blocking member 50 is just positioned between the clamp member 20 and the grout, but not directly attached to the clamp member 20. If directly attached to the clamp member 20, the grout blocking member 50 may disturb the clamping action of the clamp member 20.

FIG. 4 shows a modification of the strengthening device according to the first embodiment of the present invention. A strengthening device 1*a*' modified from the first embodiment is configured so that a hook 52 is integrally formed on the grout blocking member 50 to be hanged on the clamp member 20.

Thus, the grout blocking member 50 of FIG. 4 may be used in a more convenient way than that of the first embodiment.

In addition, the grout blocking member 50 of a plate shape as shown in FIGS. 3*a* and 3*b* and the grout blocking member 50 provided with the hook 52 as shown in FIG. 4 may be applied to the second embodiment and its modifications as they are.

Figure 5A:
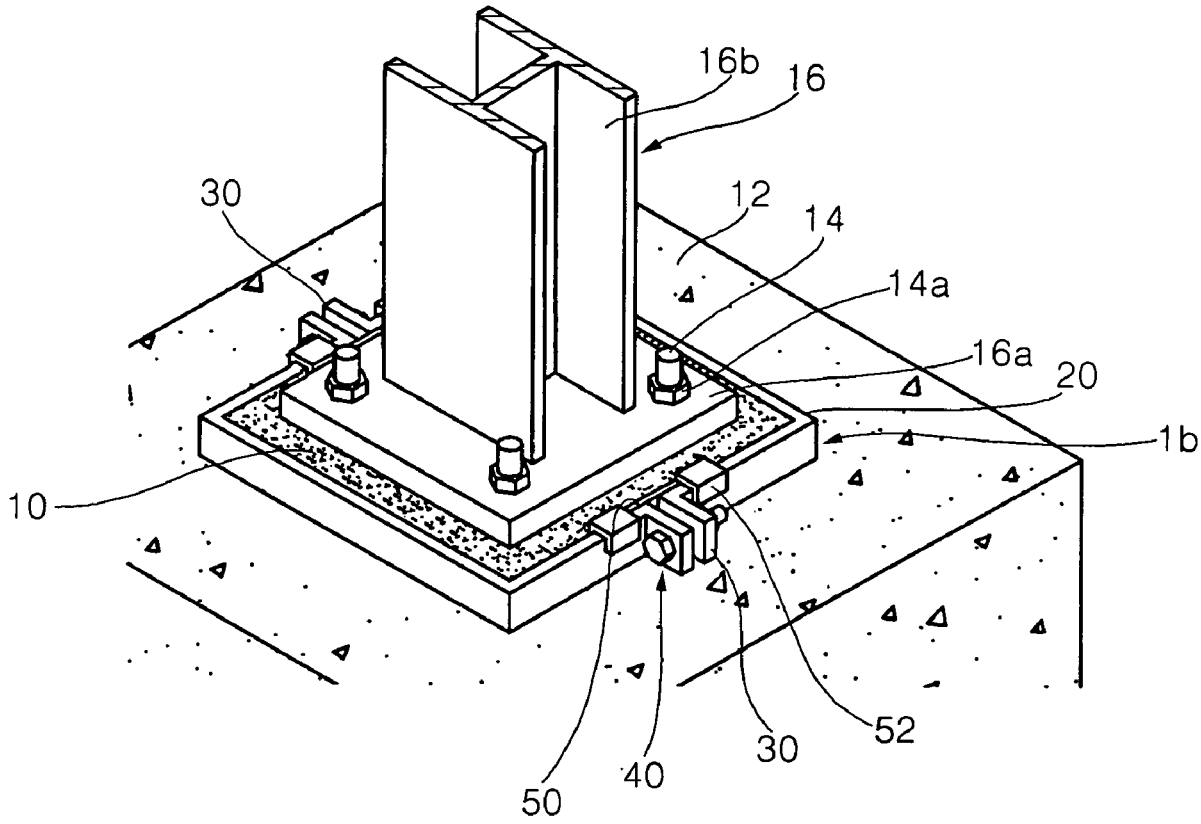
FIG. 5*a* is a perspective view illustrating an operation state of the strengthening device according to the second embodiment of the present invention.

FIG. 5*a* is a perspective view showing that the strengthening device 1*b* to increase the strength of a grout layer according to the second embodiment of the present invention as shown in FIG. 2*b* is actually used.

At this time, as shown in FIG. 5*a*, the strengthening device 1*b* of the second embodiment includes the clamp members 20, the connection members 30, the fastening means 40 and the grout blocking members 50 identically to the strengthening device 1*a* of the first embodiment, but the clamp members 20 configure a quadrangular looped section.

Thus, the strengthening device 1*b* of the second embodiment may be used for increasing the strength of the grout layer 10 while minimizing a space for an upper structure in case that the upper structure is a column member 16 with a quadrangular base plate 16*a* (see FIG. 1) or a bridge bearing (not shown) with a quadrangular base plate.

In the strengthening device 1*b* of the second embodiment, the clamp member 20 may have an angled U-shape so that two clamp members may form a quadrangular looped shape as a whole.

In addition, though not shown in the drawings, it is also possible that the clamp members have a linear shape bent at a right angle or an obtuse angle so as to increase a bearing strength by surrounding and compressing the grout layer while forming a polygonal looped section.

Figure 5B:
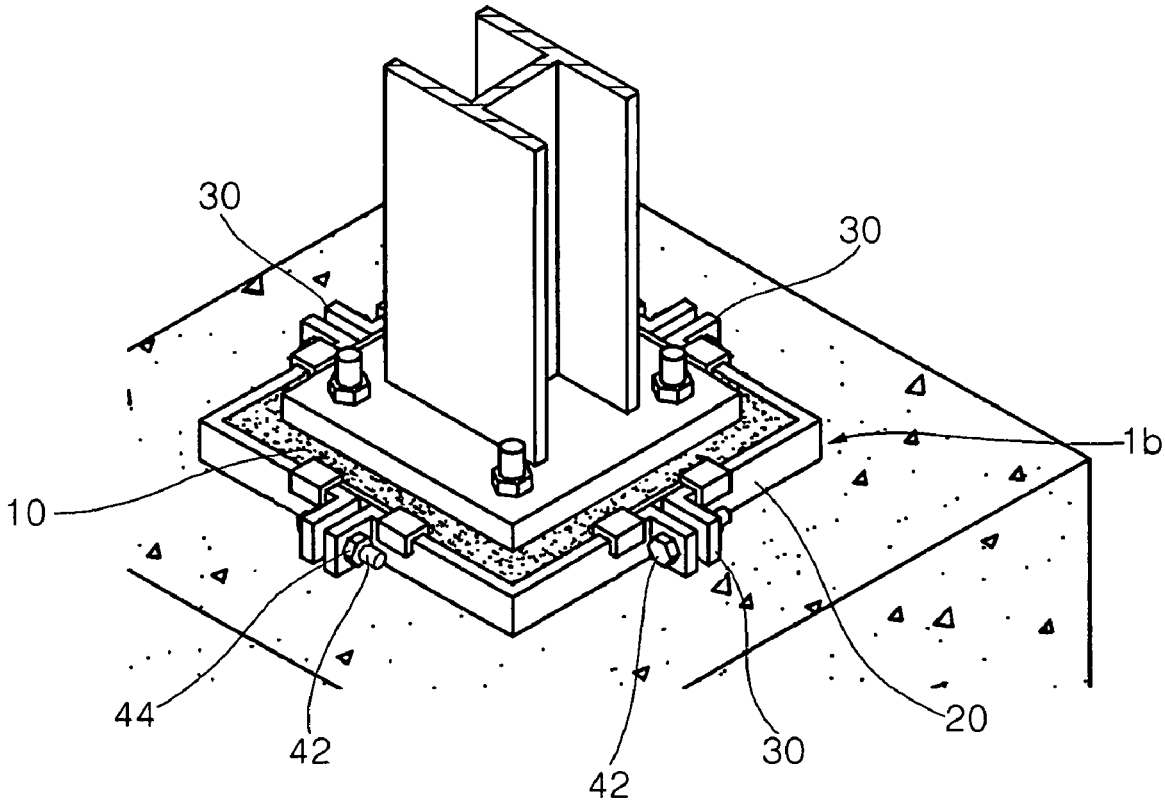
FIG. 5*b* is a perspective view illustrating a modification of the strengthening device according to the second embodiment of the present invention.

FIG. 5*b* shows a modification 1*b*' of the strengthening device to increase the strength of a grout layer according to the second embodiment of the present invention.

At this time, the strengthening device 1*b*' modified from the second embodiment is configured in a quadrangular shape as a whole, but has an increased number of the clamp members 20. That is, four clamp members 20 are used to further increase a bearing strength of the grout layer 10.

Figure 6A:
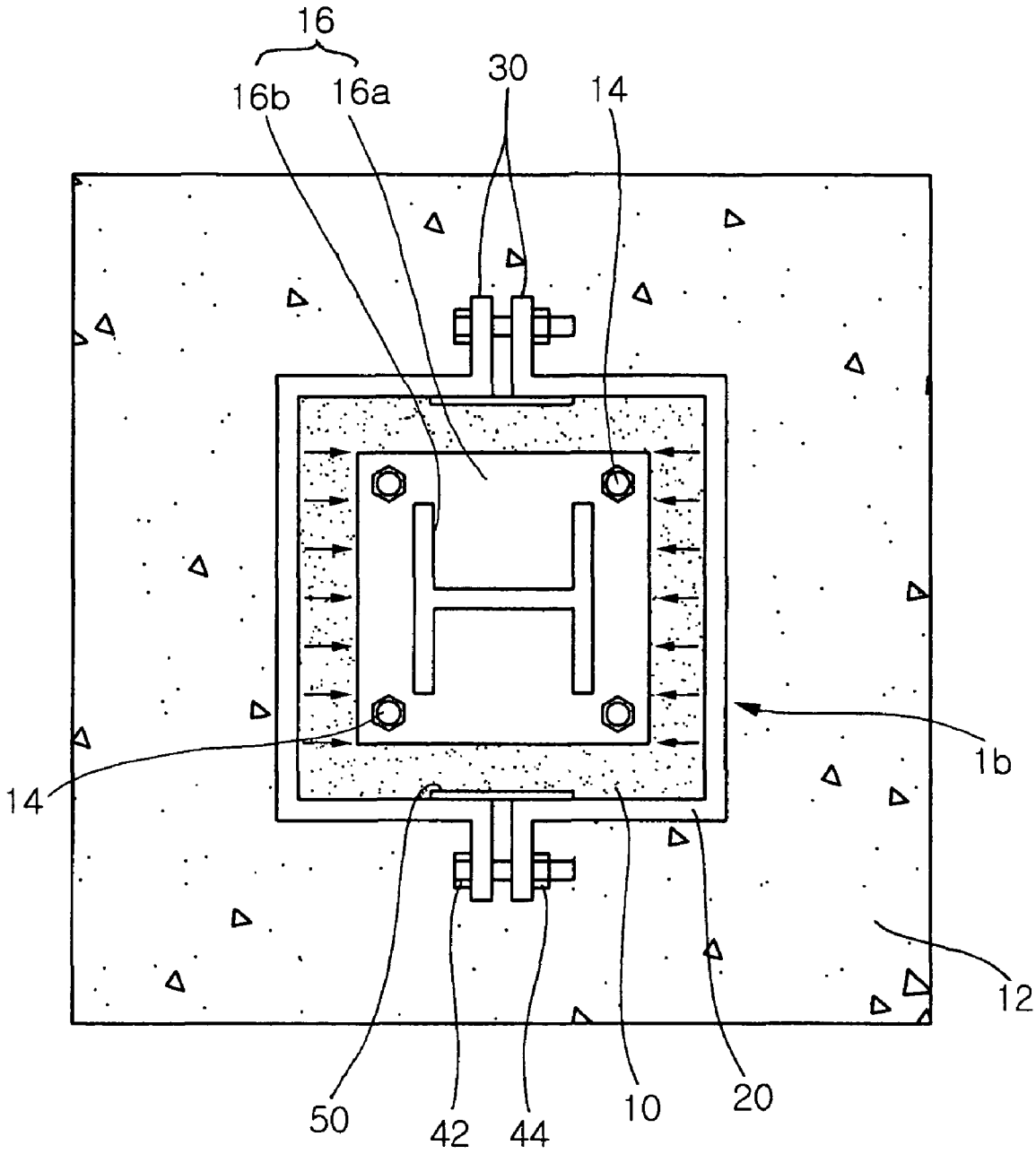
FIGS. 6*a* and 6*b* are plan views of the strengthening devices shown in FIGS. 5*a* and 5*b*, respectively.

That is to say, in the strengthening device 1*b* as shown in FIG. 6*a* in which the connection members 30 are arranged right and left and two clamp members 20 are used to increase the strength of the grout layer 10, when the connection members 30 are fastened using the fastening means 40, a restraining force compressing the grout layer 10 is actually applied only in left and right sides (see arrows in FIG. 6*a*).

Figure 6B:
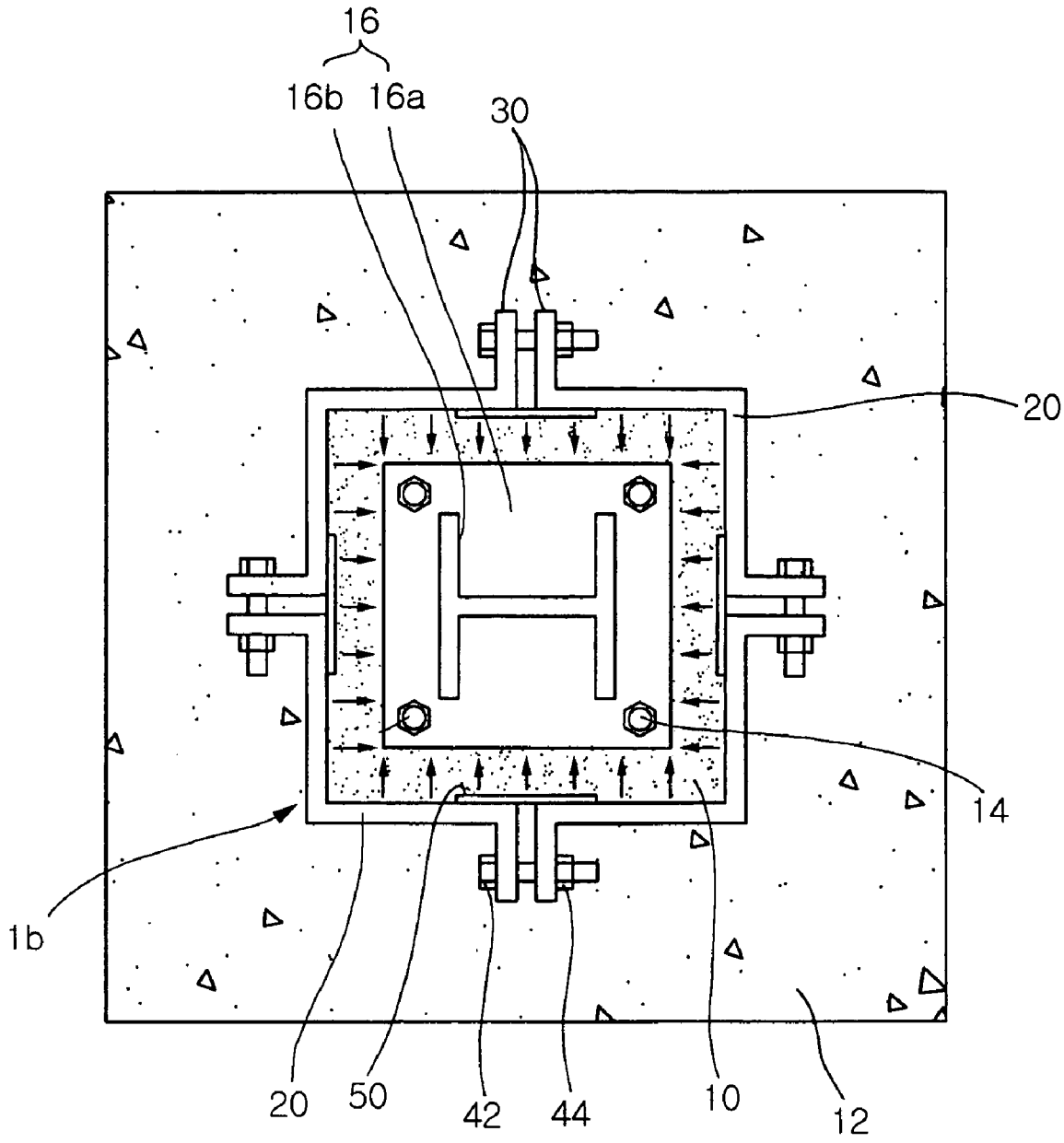

However, in case that four connection members 30 are arranged in right, left, front and rear sides and four clamp members 20 compress the grout layer 10 in total so that their gaps may be adjusted by means of the fastening means 40 as shown in FIG. 6*b*, a restraining force is applied in four directions of the grout layer 10 (see arrows in FIG. 6*b*), so the bearing strength of the grout layer 10 may be further reinforced rather than the case of FIG. 6*a*.

Thus, the strengthening device 1*b*' shown in FIG. 6*b* may be more preferably used for a grout layer requiring increased bearing strength in four directions of the grout layer, though it has somewhat complex configuration and gives some difficulty in assembling.

Meanwhile, if the number of installed clamp members 20 is increased, the weight of a unit clamp member is decreased, thereby facilitating easy carriage and handling of a unit clamp member.

Figure 7A:
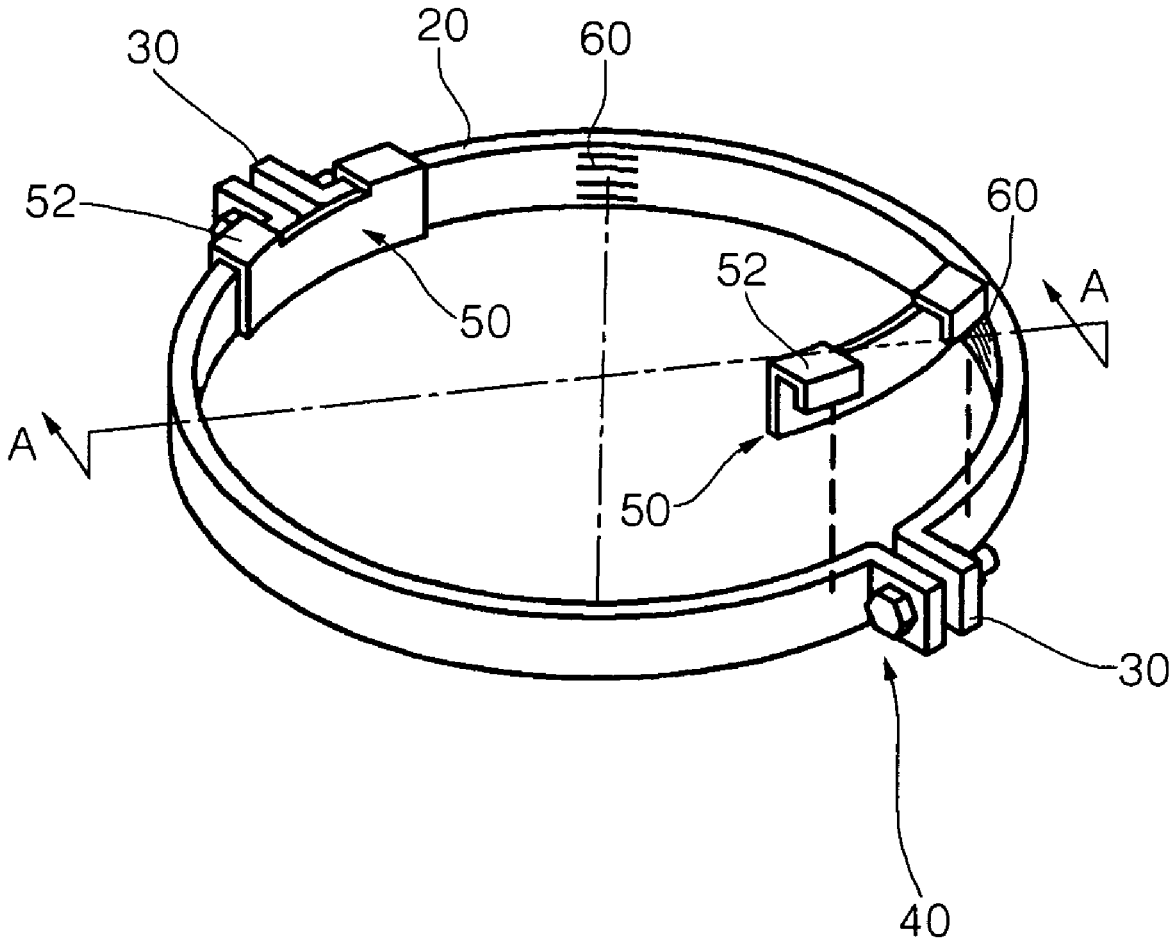
FIG. 7*a* is a perspective view of a strengthening device having a grout layer leveling unit according to the present invention.
Figure 7B:
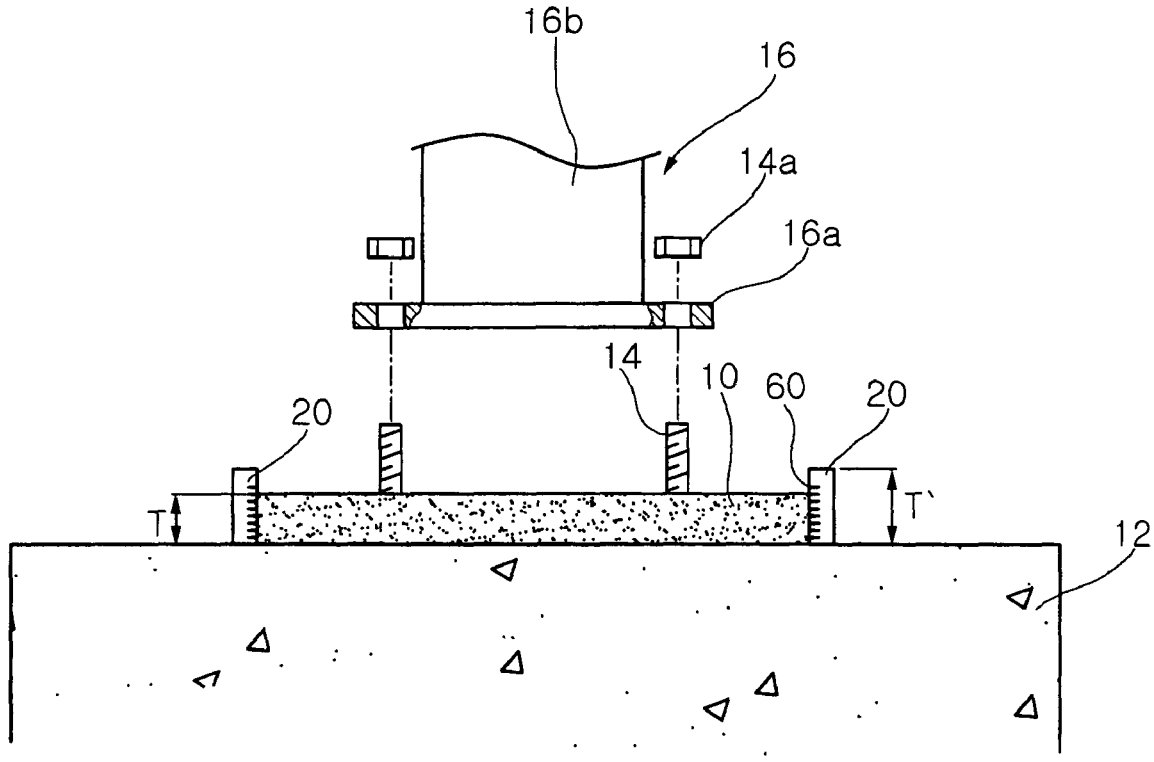
FIG. 7*b* is a front sectional elevation view taken along line A-A' of FIG. 7*a*, showing a leveled state of the grout layer.

FIGS. 7*a* and 7*b* show a strengthening device to increase the strength of a grout layer according to the present invention, which is provided with grout layer leveling means.

That is, as shown in FIG. 7*a*, a plurality of the grout layer leveling means 60 are provided on the inner wall of the clamp member 20.

At this time, the grout layer leveling means 60 may be a plurality of leveling scales provided on the inner wall of the clamp member 20.

Thus, as shown in FIG. 7*b*, the grout layer leveling means 60 enables to check whether a horizontal leveled state of the grout layer 10 is constant, in case that the strengthening device of the third embodiment of the present invention is positioned on the concrete base 12, a mold is provided by connecting the connection members 30 by means of the fastening means 40, and then grout is placed therein to form the grout layer 10.

Resultantly, the grout layer leveling means 60 of the present invention makes it possible to keep a horizontal level of the grout level constantly with using the strengthening device as a mold when grout is placed, thereby allowing easy construction of the grout layer 10.

Of course, when the strengthening device provided with the grout layer leveling means 60 is used, it should be assumed that the surface of the concrete base on which the grout layer is formed is already leveled.

At this time, as shown in FIG. 7*b*, the height of the clamp member 20 should be larger than the height (or, the vertical thickness) of the grout layer 10 in order to use the grout layer leveling means 60. Preferably, the height T of the grout layer 10 is about ⅘ of the height T' of the clamp member 20.

Meanwhile, though it is shown in FIG. 7*a* that the grout layer leveling means 60 is provided to a circular clamp member 20, it is also possible that the grout layer leveling means 60 is applied to the quadrangular clamp member 20.

Figure 8A:
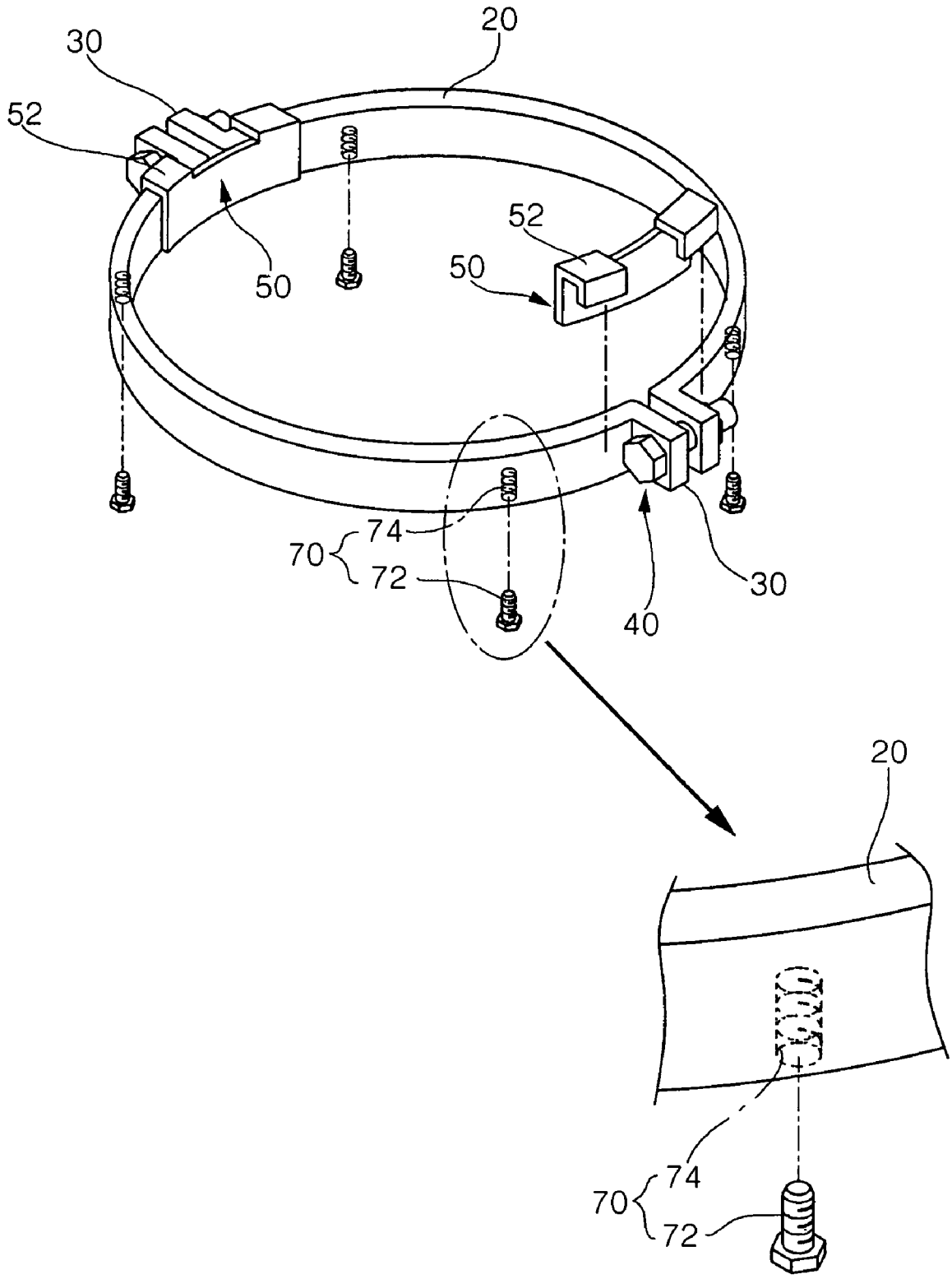
FIG. 8*a* is a perspective view of a leveling bolt coupling to a clamp member in a strengthening device having a clamp member leveling unit according to the present invention.
Figure 8B:
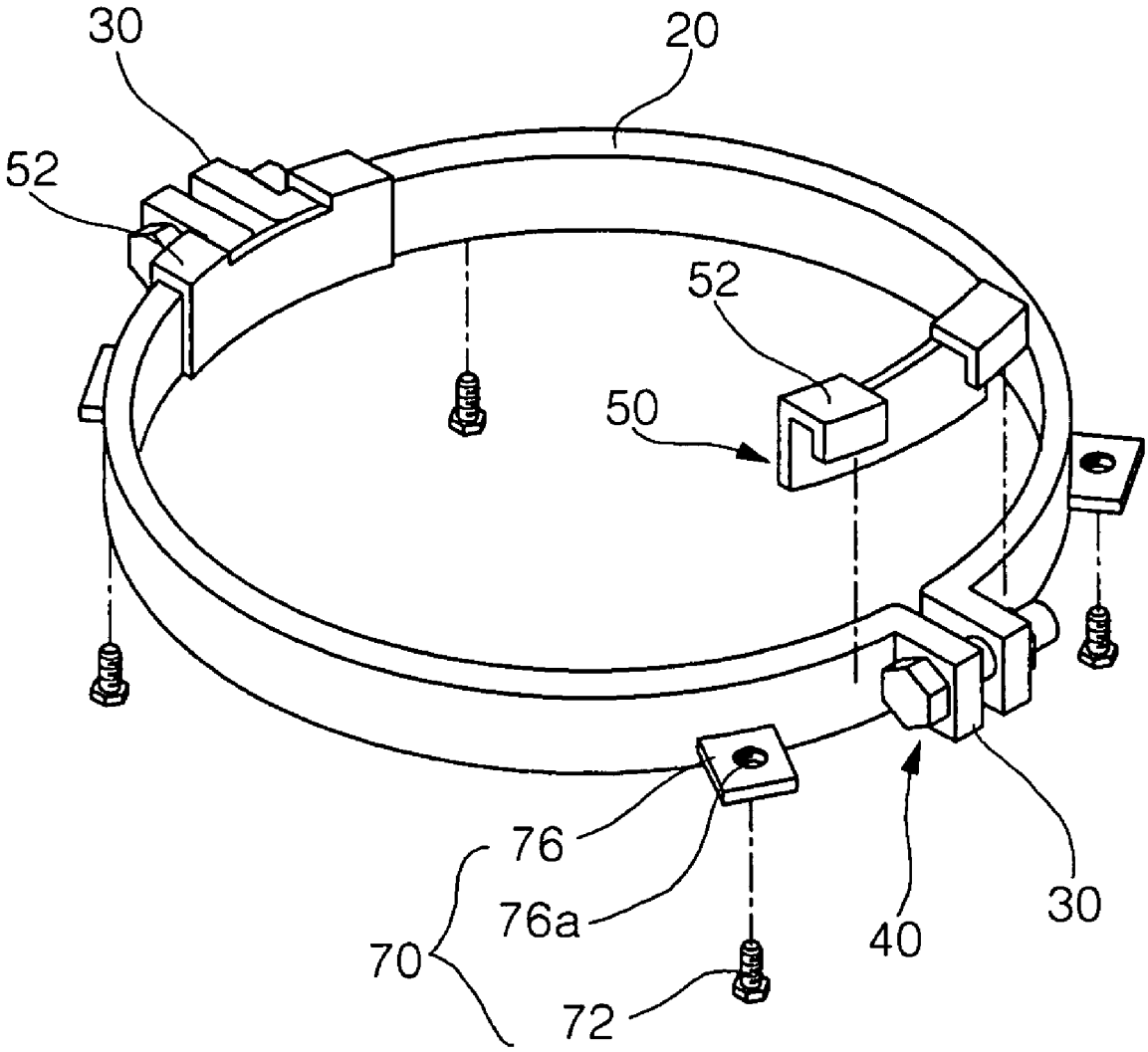
FIG. 8*b* is a perspective view of a leveling bolt coupled to a bracket of the clamp member according to the present invention.

FIGS. 8*a* and 8*b* show a strengthening device provided with a clamp member leveling means 70 that enables to adjust a level of the clamp member 20 itself.

That is to say, the clamp member leveling means 70 makes it possible to adjust a horizontal leveled state of the clamp members 20 themselves that are placed on the concrete base 12 and have circular or quadrangular looped sections. It is because a horizontal leveled state of the clamp member is not always uniform on the concrete base.

Thus, when the strengthening device of the present invention is applied so that the clamp members 20 provided with the grout layer leveling means 60 as shown in FIGS. 7*a* and 7*b* are adjusted at a uniform horizontal level on the concrete base by means of the clamp member leveling means 70 as shown in FIGS. 8*a* and 8*b*, the grout layer may be arranged at a more accurate horizontal level as a whole, more preferably.

Meanwhile, the clamp member leveling means may be provided in two types.

For example, as shown in FIG. 8*a*, the clamp member leveling means 70 of the present invention may be a leveling bolt 72 screwed into a screw groove 74 formed in a bottom of the clamp member 20 to a certain depth.

The clamp member leveling means 70 composed of the screw groove 74 formed in the clamp member and the leveling bolt 72 screwed into the screw groove 74 may be preferably provided to a plurality of points along the clamp members.

As an alternative, as shown in FIG. 8*b*, a clamp member leveling means 70 may have a leveling bolt 72 screwed into a screw hole 76*a* of a bracket 76 provided to a lower portion of the outer wall of the clamp member 20.

At this time, in case that the screw groove 74 is formed in the clamp member 20, the clamp member 20 preferably has a thickness of 5 mm or more. If the thickness of the clamp member 20 is less than 5 mm, the bracket 76 is preferably installed to the clamp member 20. It is because such thickness of the clamp member 20 should be kept, if less than 5 mm, in order to maintain a bearing strength of the grout layer.

In addition, if the leveling bolt 72 is used, a small gap may be formed between the lower end of the clamp member and the concrete base, through which non-shrinkage mortar may leak out. However, this does not disturb operation of the clamp member, thereby causing no structural problem.

At this time, if the gap formed between the clamp member and the concrete base causes any problem, non-shrinkage mortar may be filled after the gap is sealed.

As a result, the grout layer leveling means 60 and the clamp member leveling means 70 shown in FIGS. 7*a* to 8*b* can accurately keep a horizontal level of the grout layer 10 formed on the concrete base, and at the same time function to make a restraining force of the grout layer more uniform.

In addition, the grout layer leveling means 60 and the clamp member leveling means 70 are preferably used at the same time, if possible. It is because the grout layer may be accurately leveled horizontally when the clamp member 20 is accurately leveled horizontally, on the assumption that a horizontal level of the concrete base 12 is accurate.

By using the strengthening device to increase the strength of a grout layer according to the present invention, a bearing strength of the grout layer is increased, thereby making is possible to prevent or minimize crack or failure of the grout layer caused by vertical load and moment load transferred from an upper structure by means of external force such as earthquake or typhoon.

Accordingly, the strengthening device of the present invention can guarantee structural stability of the grout layer as well as the upper structure such as a column member or a bridge bearing installed on the grout layer.

As a result, the strengthening device of the present invention gives an effect of increasing life and stability of a building or a constructive structure.

Furthermore, the strengthening device of the present invention may play an additional role as a mold when grout is placed, so that there is no need to install or dissemble a separate mold for constructing a grout layer, thereby improving constructing ability and reducing costs.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A strengthening device in combination with a grout layer adapted to increase the device's strength, comprising:

a grout layer on a concrete base on which an upper structure is installed;

clamp members interconnected and clamped to surround the grout layer on the concrete base on which the upper structure is installed, so as to increase the strength of the grout layer;

connection members provided to edges of the clamp members to connect the clamp members; and fastening means fastened between the connection members in order to enable the clamp members to clamp the grout layer.

2. The strengthening device of claim 1, wherein the clamp members respectively have a curved shape so as to clamp the grout layer with forming a circular looped section.

3. The strengthening device of claim 1, wherein the clamp members respectively have a linear shape bent at a right angle or at an obtuse angle so as to clamp the grout layer with forming a polygonal looped section.

4. The strengthening device of claim 1, wherein the clamp members are made of steel material or fiber reinforced plastic (FRP).

5. The strengthening device of claim 1, wherein the connection members are formed to be integrally bent from edges of the clamp members respectively, and each of the connection members has a fastening hole into which each of the fastening means is fastened.

6. The strengthening device of claim 1, wherein the fastening means is composed of a bolt and a nut, which are fastened through a fastening hole of each connection member so as to allow the grout layer to be clamped by the clamp members.

7. The strengthening device of claim 1, further comprising grout blocking members provided between the connection, members and the grout layer so as to prevent grout from leaking out through a gap between the connection members.

8. The strengthening device of claim 7, wherein the grout blocking members are used when grout is filled, and comprise a plate provided separate from the clamp members, made of steel material or FRP corresponding to a shape of the clamp members.

9. The strengthening device of claim 7, wherein the grout blocking members additionally have a hook hanging on the clamp member.

10. The strengthening device of claim 1, further comprising a grout layer leveling means provided to the clamp member.

11. The strengthening device of claim 10, wherein the grout layer leveling means has a leveling scale integrally formed on at least one point of an inner wall of the clamp member.

12. The strengthening device of claim 1, further comprising a clamp member leveling means for adjusting a level state of the clamp members themselves placed on the concrete base.

13. The strengthening device of 12, wherein the clamp member leveling means has a leveling bolt fastened into a plurality of screw grooves formed in bottoms of the clamp members or with screw holes formed in a plurality of brackets installed to outer walls of the clamp members.

* * * * *

UNITED STATES PATENT AND TRADEMARK OFFICE

CERTIFICATE OF CORRECTION

PATENT NO. : 7,721,494 B2
APPLICATION NO. : 11/179718
DATED : May 25, 2010
INVENTOR(S) : Lee

It is certified that error appears in the above-identified patent and that said Letters Patent is hereby corrected as shown below:

Column 10, line 3, Claim 1, "to increase the device's strength, comprising"
should read
-- to increase the strength of a grout layer, comprising --.

Signed and Sealed this

Fifth Day of October, 2010

David J. Kappos

David J. Kappos
*Director of the United States Patent and Trademark Office*